US005453569A

United States Patent [19]

Saito et al.

[11] Patent Number: 5,453,569

[45] Date of Patent: Sep. 26, 1995

[54] APPARATUS FOR GENERATING TONES OF MUSIC RELATED TO THE STYLE OF A PLAYER

[75] Inventors: Tsutomu Saito; Naoto Utsumi, both of Hamamatsu, Japan

[73] Assignee: Kabushiki Kaisha Kawai Gakki Seisakusho, Shizuoka, Japan

[21] Appl. No.: 23,375

[22] Filed: Feb. 26, 1993

[30] Foreign Application Priority Data

Mar. 11, 1992 [JP] Japan ..... 4-103447

[51] Int. Cl.[6] ..... G10H 7/00; G04B 13/00; A63H 5/00

[52] U.S. Cl. ..... 84/609; 84/626

[58] Field of Search ..... 84/609 612, 84/626, 462

[56] References Cited

U.S. PATENT DOCUMENTS

| | | | |
|---|---|---|---|
| 4,930,390 | 6/1990 | Kellogg et al. | 84/611 |
| 5,063,820 | 11/1991 | Yamada | 84/609 |
| 5,092,216 | 3/1992 | Wadhams | 84/609 |
| 5,225,618 | 7/1993 | Wadhams | 84/602 |

*Primary Examiner*—William M. Shoop, Jr.
*Assistant Examiner*—Jeffrey W. Donels

[57] ABSTRACT

An automatic performance apparatus extracts characteristic data indicating individuality of performance of a player from performance data, compensates for score data exhibiting no individuality by the characteristic data, and executes an automatic performance using the compensated data. The apparatus includes a characteristic extraction unit and a characteristic regeneration unit. The characteristic extraction unit extracts characteristic data on the basis of a correlation between performance data and score data, and stores the extracted data in a characteristic data storage unit. The characteristic data is extracted with regard to styles of performance in association with notes, signs attached to the notes, dynamic marks, tempo marks, the general flow of music, and the like with reference to score data exhibiting no individuality. The characteristic regeneration unit compensates for arbitrary score data with the stored characteristic data to generate performance data. An electronic musical instrument is controlled based on the performance data, thereby obtaining automatic performance tones exhibiting the individuality of the player.

11 Claims, 13 Drawing Sheets

FIG. 4

PERFORMANCE DATA M (i)

| | |
|---|---|
| PNT+0 | DELTA TIME |
| PNT+1 | KEY-ON INFO F0h |
| PNT+2 | KEY NO. |
| PNT+3 | INIT TOUCH |

| | |
|---|---|
| PNT+0 | DELTA TIME |
| PNT+1 | KEY-OFF INFO F1h |
| PNT+2 | KEY NO. |
| PNT+3 | (NOT USED) |

| | |
|---|---|
| PNT+0 | DELTA TIME |
| PNT+1 | FOOT SW INFO F2h |
| PNT+2 | SW NO. |
| PNT+3 | OPN AMT |

| | |
|---|---|
| PNT+0 | DELTA TIME |
| PNT+1 | AFT TOUCH INFO F3h |
| PNT+2 | AFT TOUCH |
| PNT+3 | (NOT USED) |

| | |
|---|---|
| PNT+0 | DELTA TIME |
| PNT+1 | TONE CLR INFO F4h |
| PNT+2 | TONE CLR CODE |
| PNT+3 | (NOT USED) |

| | |
|---|---|
| PNT+0 | DELTA TIME |
| PNT+1 | VOLUME INFO F5h |
| PNT+2 | TONE CLR CODE |
| PNT+3 | (NOT USED) |

| | |
|---|---|
| PNT+0 | DELTA TIME |
| PNT+1 | EFFECT INFO F6h |
| PNT+2 | EFFECT CODE |
| PNT+3 | (NOT USED) |

| | |
|---|---|
| PNT+0 | DELTA TIME |
| PNT+1 | SND EFT INFO F7h |
| PNT+2 | SND EFT CODE |
| PNT+3 | (NOT USED) |

| | |
|---|---|
| PNT+0 | DELTA TIME |
| PNT+1 | TIME DURATION INFO FEh |
| PNT+2 | DELTA TIME (L) |
| PNT+3 | DELTA TIME (H) |

| | |
|---|---|
| PNT+0 | DELTA TIME |
| PNT+1 | END INFO FFh |
| PNT+2 | (NOT USED) |
| PNT+3 | (NOT USED) |

FIG. 5

SCORE DATA M

INITIAL DATA

| | |
|---|---|
| PNT+0 | START ADRS OF 1ST STAFF |
| PNT+1 | START ADRS OF 2ND STAFF |
| PNT+2 | START ADRS OF 3RD STAFF |
| PNT+3 | START ADRS OF 4TH STAFF |
| PNT+4 | G CLEF/F CLEF MARK |
| PNT+5 | KEY SIGNATURE |
| PNT+6 | TIME SIGNATURE |
| PNT+7 | TEMPO MARK |

MAIN DATA

| | |
|---|---|
| PNT+0 | STEP TIME |
| PNT+1 | NOTE MARK<F0h |
| PNT+2 | KEY NO. |
| PNT+3 | ADDITIONAL CODE |

| | |
|---|---|
| PNT+0 | STEP TIME |
| PNT+1 | DYNAMIC INFO F9h |
| PNT+2 | DYNAMIC MARK |
| PNT+3 | (NOT USED) |

| | |
|---|---|
| PNT+0 | STEP TIME |
| PNT+1 | TEMPO DATA FAh |
| PNT+2 | TEMPO MARK |
| PNT+3 | (NOT USED) |

| | |
|---|---|
| PNT+0 | STEP TIME |
| PNT+1 | REPEAT INFO FBh |
| PNT+2 | REPEAT MARK |
| PNT+3 | (NOT USED) |

| | |
|---|---|
| PNT+0 | STEP TIME |
| PNT+1 | BAR INFO FEh |
| PNT+2 | BEAT CODE |
| PNT+3 | (NOT USED) |

| | |
|---|---|
| PNT+0 | STEP TIME |
| PNT+1 | END INFO FFh |
| PNT+2 | (NOT USED) |
| PNT+3 | (NOT USED) |

FIG. 6

CHARACTERISTIC DATA (REG+0–13)

| PERFORMANCE CHECK FOR NOTES OR SIGNS ATTACHED TO NOTES | | |
|---|---|---|
| REGISTER | CHECK ITEM | CHARACTERISTIC DATA |
| REG+0 | SUCCESSIVE PLAY OF SIXTEENTH NOTES | TIMING, TOUCH |
| REG+1 | PLAY OF A SIXTEENTH NOTE PLUS AN EIGHTH NOTE | TIMING, TOUCH |
| REG+2 | PLAY OF AN EIGHTH NOTE PLUS SIXTEENTH NOTE | TIMING, TOUCH |
| REG+3 | SUCCESSIVE PLAY OF EIGHTH NOTES | TIMING, TOUCH |
| REG+4 | PLAY OF AN EIGHTH NOTE PLUS A QUARTER NOTE | TIMING, TOUCH |
| REG+5 | PLAY OF AN QUARTER NOTE PLUS AN EIGHTH NOTE | TIMING, TOUCH |
| REG+6 | SUCCESSIVE PLAY OF QUARTER NOTE | TIMING, TOUCH |
| REG+7 | PLAY OF A HALF NOTE | TIMING, TOUCH |
| REG+8 | PLAY OF A TRIRLET | TIMING, TOUCH |
| REG+9 | STACCATO PLAY | TIMING, TOUCH |
| REG+10 | ACCENTO PLAY | TIMING, TOUCH |
| REG+11 | PEDAL PLAY | TIMING |
| REG+12 | TIE PLAY | TIMING, TOUCH |
| REG+13 | SLUR PLAY | TIMING, TOUCH |

FIG. 7

CHARACTERISTIC DATA (REG+14–21)

| PERFORMANCE CHECK FOR TEMPO MARKS | | |
|---|---|---|
| REGISTER | CHECH ITEM | CHRST DATA |
| REG+14 | adagio PLAY | TEMPO |
| REG+15 | andante PLAY | TEMPO |
| REG+16 | moderato PLAY | TEMPO |
| REG+17 | allegro PLAY | TEMPO |
| REG+18 | presto PLAY | TEMPO |
| REG+19 | rit.PLAY | TERMINATION TIME,VARIATION OF TEMPO |
| REG+20 | accel PLAY | TERMINATION TIME,VARIATION OF TEMPO |
| REG+21 | a tempo PLAY | TERMINATION TIME |

FIG. 8

CHARACTERISTIC DATA (REG+22–29)

| PERFORMANCE CHECK FOR DYNAMIC MARKS | | |
|---|---|---|
| REGISTER | CHECK ITEM | CHRST DATA |
| REG+22 | pp (pianissimo) PLAY | TOUCH |
| REG+23 | p (piano) PLAY | TOUCH |
| REG+24 | mp (mezzo piano) PLAY | TOUCH |
| REG+25 | mf (mezzo forte) PLAY | TOUCH |
| REG+26 | f (forte) PLAY | TOUCH |
| REG+27 | ff (fortessimo) PLAY | TOUCH |
| REG+28 | crescendo PLAY | TERMINATION TIME,VARIATION OF TOUCH |
| REG+29 | decrecendo PLAY | TERMINATION TIME,VARIATION OF TOUCH |

FIG. 9

CHARACTERISTIC DATA (REG+30–33)

| PERFORMANCE CHECK FOR GENERAL FLOW OF MUSIC | | |
|---|---|---|
| REGISTER | CHECK ITEM | CHRST DATA |
| REG+30 | PLAY OF THE FIRST PORTION OF MUSIC | TEMPO, TOUCH |
| REG+31 | 1ST PLAY OF A REPEAT PORTION | TEMPO, TOUCH |
| REG+32 | 2ND PLAY OF A REPEAT PORTION | TEMPO, TOUCH |
| REG+33 | PLAY OF THE LAST PORTION OF MUSIC | TEMPO, TOUCH |

FIG. 10

TEMPO SEQUENCE AND TOUCH SEQUENCE
GENERATED IN SCORE DATA COMPENSATION BLK

| | |
|---|---|
| PNT+0 | STEP TIME |
| PNT+1 | TEMPO INFO FCh |
| PNT+2 | TEMPO DATA |
| PNT+3 | (NOT USED) |

| | |
|---|---|
| PNT+0 | STEP TIME |
| PNT+1 | TOUCH INFO FDh |
| PNT+2 | TOUCH DATA |
| PNT+3 | (NOT USED) |

| | |
|---|---|
| PNT+0 | STEP TIME |
| PNT+1 | BAR INFO FEh |
| PNT+2 | BEAT CODE |
| PNT+3 | BAR MIDWAY INFO |

| | |
|---|---|
| PNT+0 | STEP TIME |
| PNT+1 | END INFO FFh |
| PNT+2 | (NOT USED) |
| PNT+3 | (NOT USED) |

FIG. 11

NOTE SEQUENCE GENERATED IN SCORE DATA COMPENSATION BLK

| | |
|---|---|
| PNT+0 | STEP TIME |
| PNT+1 | GATE TIME>F0 |
| PNT+2 | KEY NO. |
| PNT+3 | INITIAL TOUCH |

| | |
|---|---|
| PNT+0 | STEP TIME |
| PNT+1 | FOOT SW INFO F2h |
| PNT+2 | PEDAL OPN AMT |
| PNT+3 | (NOT USED) |

| | |
|---|---|
| PNT+0 | STEP TIME |
| PNT+1 | AFT TOUCH INFO F3h |
| PNT+2 | AFTER TOUCH |
| PNT+3 | (NOT USED) |

| | |
|---|---|
| PNT+0 | STEP TIME |
| PNT+1 | TONE CLR INFO F4h |
| PNT+2 | TONE CLR CODE |
| PNT+3 | (NOT USED) |

| | |
|---|---|
| PNT+0 | STEP TIME |
| PNT+1 | VOLUME INFO F5h |
| PNT+2 | VOLUME CODE |
| PNT+3 | (NOT USED) |

| | |
|---|---|
| PNT+0 | STEP TIME |
| PNT+1 | EFFECT INFO F6h |
| PNT+2 | EFFECT CODE |
| PNT+3 | (NOT USED) |

| | |
|---|---|
| PNT+0 | STEP TIME |
| PNT+1 | SND EFT INFO F7h |
| PNT+2 | SND EFT CODE |
| PNT+3 | (NOT USED) |

| | |
|---|---|
| PNT+0 | STEP TIME |
| PNT+1 | BAR INFO FEh |
| PNT+2 | BEAT INFO |
| PNT+3 | BAR MIDWAY INFO |

| | |
|---|---|
| PNT+0 | STEP TIME |
| PNT+1 | END INFO FFh |
| PNT+2 | (NOT USED) |
| PNT+3 | (NOT USED) |

FIG. 12

TRIPLET PERFORMANCE DATA

| | PRFM DATA BASED ON SCORE DATA | | PRFM DATA EXAMPLE 1 | PRFM DATA EXAMPLE 2 |
|---|---|---|---|---|
| PNT+0 | ** | D-TIME | ** | ** |
| PNT+1 | F0h | KEY-ON | F0h | F0h |
| PNT+2 | 36h | KEY NO. | 36h | 36h |
| PNT+3 | 100 | TOUCH | 94 | 110 |
| PNT+4 | 24 | D-TIME | 23 | 31 |
| PNT+5 | F1h | KEY-OFF | F1h | F1h |
| PNT+6 | 36h | KEY NO. | 36h | 36h |
| PNT+7 | ** | | ** | ** |
| PNT+8 | 08 | D-TIME | 08 | 10 |
| PNT+9 | F0h | KEY-ON | F0h | F0h |
| PNT+10 | 36h | KEY NO. | 36h | 36h |
| PNT+11 | 100 | TOUCH | 106 | 97 |
| PNT+12 | 24 | D-TIME | 29 | 22 |
| PNT+13 | F1h | KEY-OFF | F1h | F1h |
| PNT+14 | 36h | KEY NO. | 36h | 36h |
| PNT+15 | ** | | ** | ** |
| PNT+16 | 08 | D-TIME | 09 | 08 |
| PNT+17 | F0h | KEY-ON | F0h | F0h |
| PNT+18 | 36h | KEY NO. | 36h | 36h |
| PNT+19 | 100 | TOUCH | 100 | 101 |
| PNT+20 | 24 | D-TIME | 25 | 24 |
| PNT+21 | F1h | KEY-OFF | F1h | F1h |
| PNT+22 | 36h | KEY NO. | 36h | 36h |
| PNT+23 | ** | | ** | ** |
| PNT+24 | 08 | D-TIME | 07 | 09 |

APPARATUS FOR GENERATING TONES OF MUSIC RELATED TO THE STYLE OF A PLAYER

BACKGROUND OF THE INVENTION

1. Field of the Invention

The present invention relates to an apparatus for storing/regenerating instrument performance data of a player and, more particularly, to an apparatus for extracting and storing an individuality of a performance (characteristic data) of a player by comparing score data and instrument performance information of the player, and, in a regeneration mode, adding the stored characteristic data to score data and executing an automatic instrument performance.

2. Description of the Related Art

An electronic musical instrument for example, a piano has an apparatus for storing a performance of a player. The performance data storage/playback apparatus is designed to faithfully store and regenerate a performance state of an arbitrary player. The recent advanced digital technique allows to reliably store/playback a large amount of performance data.

Such a performance data storage/playback apparatus is comparable to a recorder, and can merely store/playback played data although the recorder stores performance data as analog tone data from a microphone, whereas the apparatus stores performance data as digital data including operated key numbers and time information.

Therefore, the performance data plays back a given music piece, and when another music piece is to be played back, it must be recorded. If there is data of a music piece M played by a famous pianist, the performance data is data for the music piece M, and cannot be utilized for another music piece N. Of course, there is a prior art technique for mechanically playing score data of the music pieces M or N. However, such a performance is a mechanical one and lacks a human touch, and a listener soon tires of such a performance. The human touch is the individuality of a player.

SUMMARY OF THE INVENTION

It is an object of the present invention to provide an apparatus, which compensates for a music piece, which has never been played by a given player, with stored characteristic data extracted from performance data of a music piece, which was played by the player so as to imitate the individuality of a performance of the player, and provides a natural and delicate music to an audience. For this purpose, the present invention has a characteristic extraction unit for extracting characteristics of a performance, and a score compensation unit for compensating for score data on the basis of the extracted characteristics.

Even a famous player has a noticeable individuality (characteristics of a performance) in his or her style of performance, and when the characteristic data is added to score data of another music piece, a performance can be regenerated as if the player were playing the music piece. Units for extracting and regenerating characteristics of an instrument player according to the present invention compare individual performance data and original score data to extract and store characteristic data, and score data is compensated with the characteristic data in regeneration.

In order to extract characteristics of a performance of a player, performance data played by the player based on a score is digitally stored. The stored performance data and the score data are compared with each other. The comparison is made on the basis of the score data, and a style of performance for notes or signs attached to the notes, a style of performance for dynamic marks, a style of performance for tempo marks, a style of performance for the general flow of music, and the like are extracted and stored as characteristic data. The styles of performance differ in operation timings associated with key depression/key release times, operation touches associated with initial touch/after touch, an operation tempo associated with a performance speed, and the like.

The extracted and stored characteristic data can be utilized for compensating for arbitrary score data when it is read out. For this reason, a listener can listen to performance data obtained by compensating for the score data as if the player were actually playing the corresponding music piece.

BRIEF DESCRIPTION OF THE DRAWINGS

FIG. 4 is a view showing a storage format of performance data;

FIG. 5 is a view showing a storage format of score data;

FIGS. 6 to 9 are views showing performance check items and characteristic data;

FIGS. 10 and 11 are views showing tempo sequence, touch sequence, and note sequence data generated by the score data compensation unit; and FIG. 12 is a view showing performance data to be regenerated, and original score data.

DETAILED DESCRIPTION OF THE PREFERRED EMBODIMENT

Figure 1:
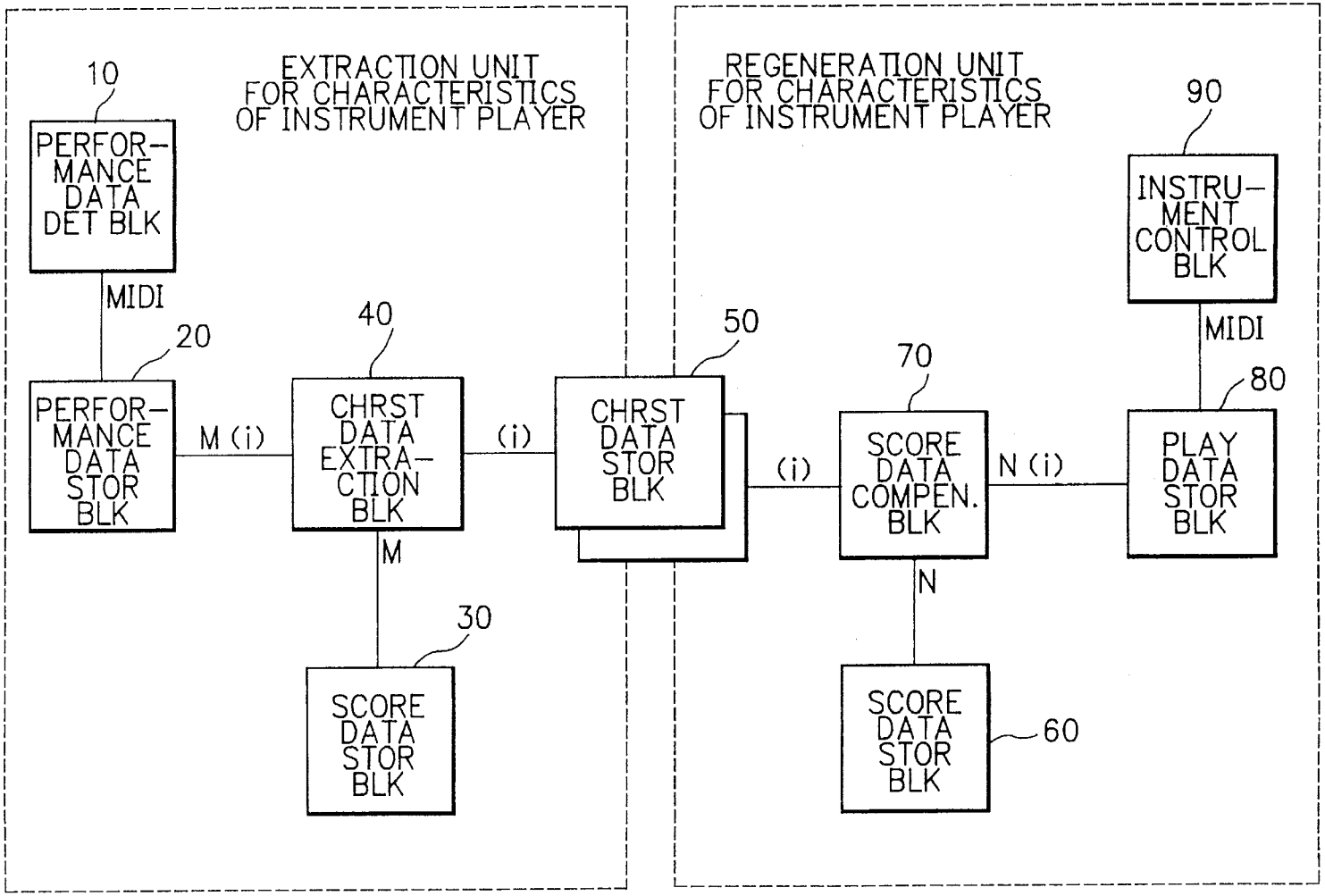
FIG. 1 is a block diagram of the present invention.
Figure 2A:
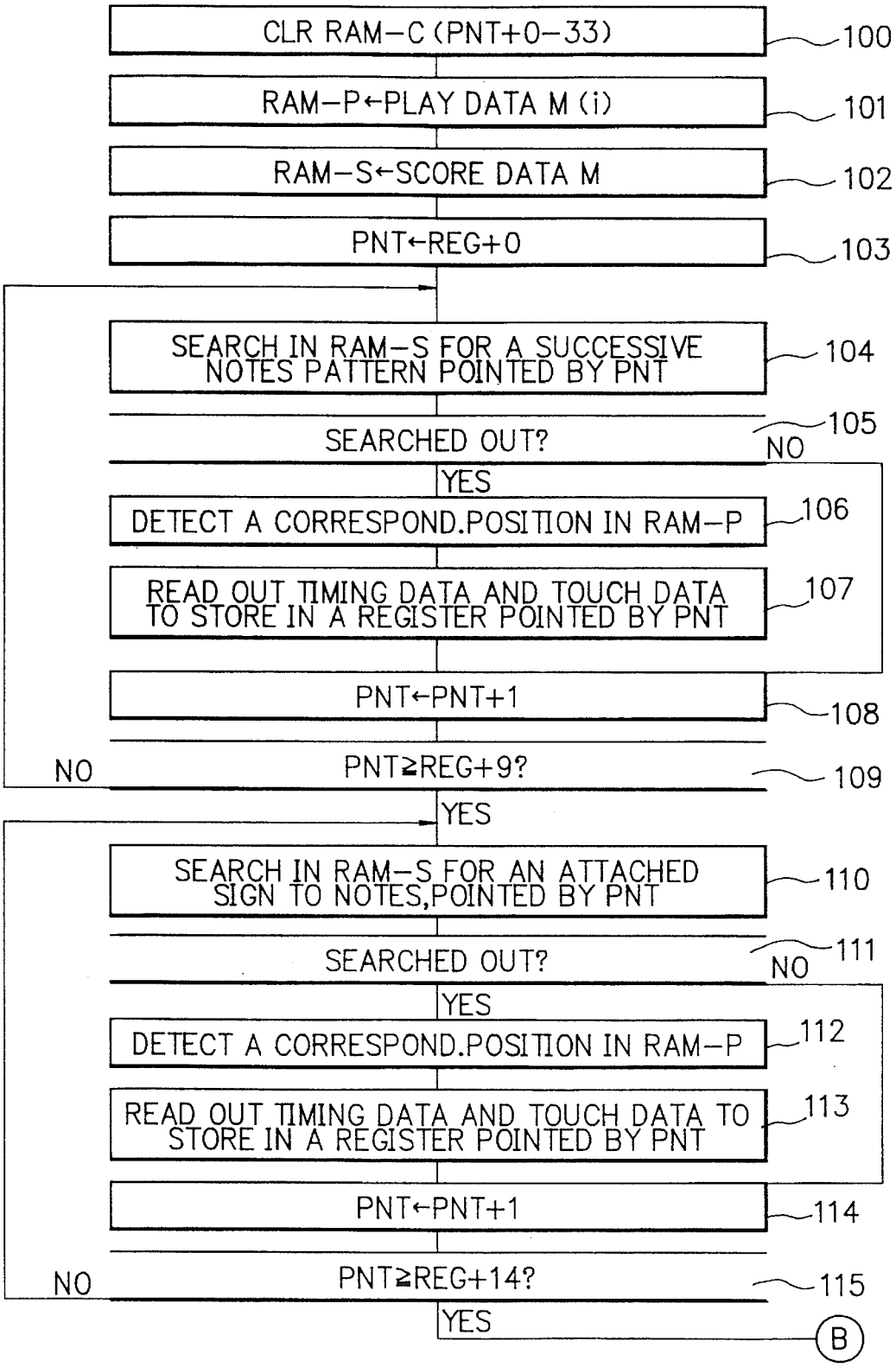
FIGS. 2A to 2D are flow charts of a characteristic data extraction unit.
Figure 2B:
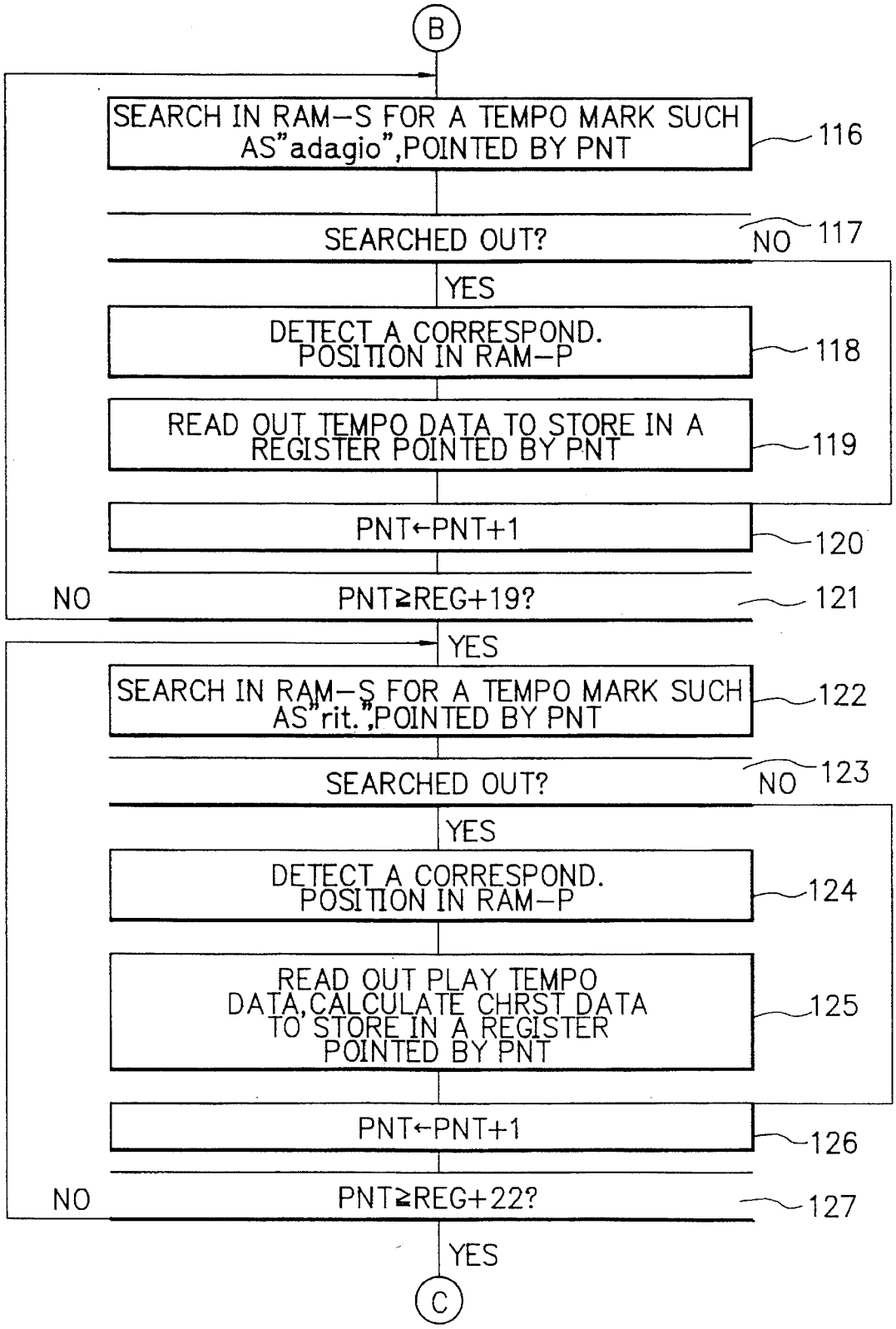
Figure 2C:
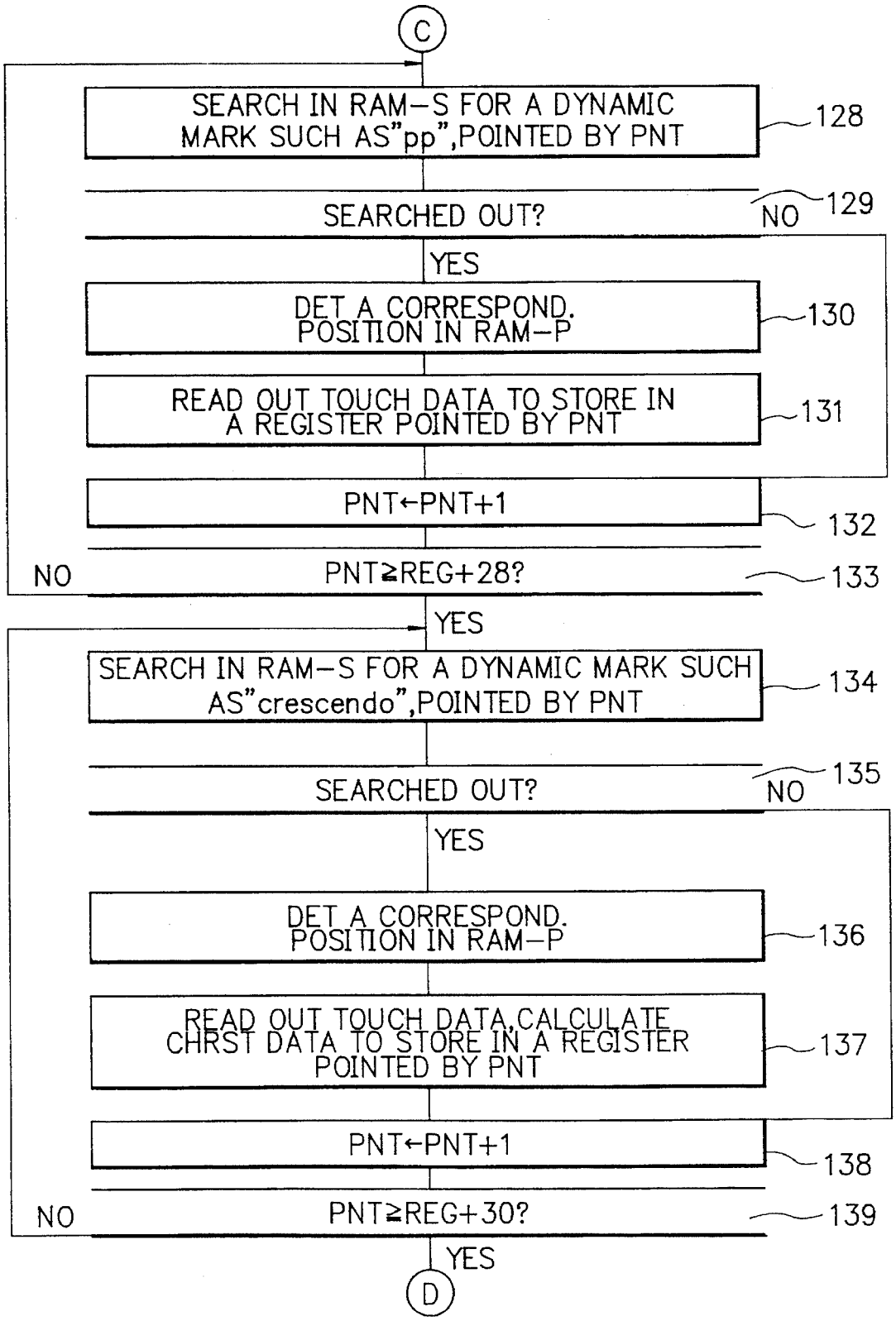
Figure 2D:
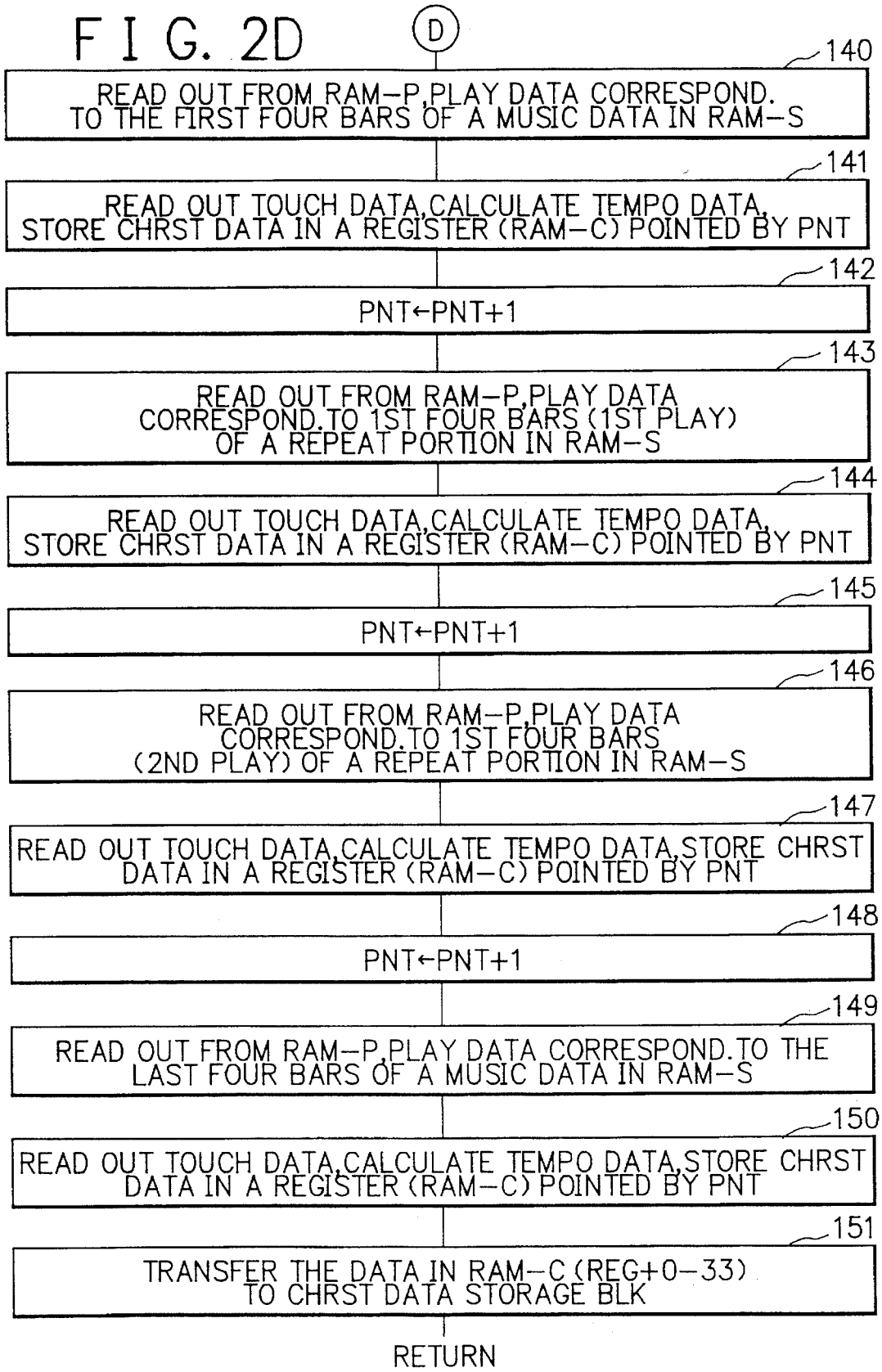

FIG. 1 is a block diagram of the present invention. The arrangement shown in FIG. 1 is roughly divided into an extraction unit ENC (Encoder) for characteristics of an instrument player and a regeneration unit DEC (Decoder) for characteristics of an instrument player. A characteristic data storage block for storing characteristic data of a performance is present between these units, and both the units function as independent units.

The extraction unit ENC for characteristics of the instrument player will be described first. A performance data detection block 10 detects instrument operation data obtained when a player i plays a musical instrument M, and outputs the detected data as data according to the MIDI standards. The performance data detection block 10 has a function equivalent to that of an operation state detection means incorporated in a conventional electronic musical instrument or an automatic player piano.

A performance data storage block 20 receives the instrument operation data obtained when the player i plays the musical instrument M, adds time information thereto, and stores the sum data as performance data M(i). The time information represents a time interval from the immediately preceding operation data (event), and has a resolution on the order of milliseconds (ms). This management method of the time information may seem wasteful as compared to a conventional sequencer (performance data storage/playback apparatus) which defines time information to have a resolution of about 1/24 a quarternote with reference to a tempo. However, the present invention adopts this method so that a player can follow a change in tempo during a performance.

Upon expression of the performance data, performance data obtained when a player j plays a score M is expressed by M(j), and performance data obtained when a player k plays a score N is expressed by N(k).

FIG. 4 shows the storage format of performance data M(i) stored in the performance data storage block 20. As shown in FIG. 4, the performance data M(i) is constituted by (time information+MIDI code). More specifically, the performance data is defined by a combination of a relative time (to be referred to as a delta time hereinafter) between the immediately preceding operation and the current operation, corresponding operation member information, and a corresponding operation amount (operation speed). 1-byte information allows measurement of the delta time only within a range between 0 and 255 ms. For this reason, when a long interval is taken between two adjacent operations, time duration information for specially prolonging the delta time is used. Furthermore, since the performance data M(i) has no "repeat" information on a score, substantially the same MIDI codes are repetitively detected and stored in a repeat performance.

As shown in FIG. 4, performance data obtained upon performance of an automatic performance piano need only be constituted by five kinds of information, i.e., key-ON information (including initial touch information), key-OFF information, foot SW (switch) information, time duration information, and end information. The foot SW information includes information having two levels (ON and OFF levels) like a damper pedal, and information having a large number of levels like a half pedal.

As shown in FIG. 4, performance data obtained upon performance of an electronic musical instrument requires AFT touch (after touch) information, tone color information, tone volume information, effect information (vibrato, sustain, tune, and the like), and sound effect information (reverberation, panning, and the like) in addition to the above-mentioned five kinds of information.

A score data storage block 30 stores notes and various signs on a score. The score data storage block 30 can store a plurality of music pieces. In FIG. 1, a music piece M is about to be read out from the score data storage block 30.

FIG. 5 shows the storage format of score data M stored in the score data storage block 30. The score data M is constituted by (time position information on score+code). More specifically, the score data is defined by a combination of time information (step time) representing a time from the beginning of a bar at a resolution of 1/24 a quarternote, and a note or sign on a score. For this reason, information representing the time position of each bar is prepared.

The score data M stores, as initial data, the start addresses of four staffs, a G clef/F clef mark, a key signature, a time signature, and a tempo mark. The start addresses of the four staffs are prepared since a plurality of parts which are simultaneously started to play are independently stored. Of course, the number of staffs is not limited to four.

In addition to the initial data, the score data M has, as main data, note information (including information attached to a note), dynamic information, tempo information, repeat information, bar information, and end information. In particular, since the score data has the "repeat" information unlike in the performance data, information about a repeat performance is stored at only one position.

A characteristic data extraction block 40 comprises a CPU or a DSP (digital signal processor), a ROM, and a RAM. The block 40 reads the performance data M(i) obtained when the player i plays the score M, and original score data M of the music piece, and checks a correlation therebetween to extract the individuality of a performance of the player as characteristic data (i). When the characteristic data (i) is extracted, the score data is classified into the following four criterions, and the styles of performance are compared in the respective criterions.

First: performance about note marks or signs attached to notes

Second: performance about tempo marks

Third: performance about dynamic marks

Fourth: performance about general flow of music

A characteristic data storage block 50 stores the individuality of the performance of the player i in an external storage unit such as an IC card, a magnetic disk, an optical disk, or the like as the characteristic data (i). Characteristic data extracted from performance data of a player j is expressed by (j), and characteristic data extracted from performance data of a player k is expressed by (k).

The above-mentioned performance data storage block 20, score data storage block 30, and characteristic data storage block 50 are storage units, and may comprise any storage units as long as they allow read/write accesses. However, it is desirable to substitute these storage blocks with a large-capacity, portable storage unit such as a magnetic disk, an optical disk, or the like. This is because the performance data M(i) need not then be read out simultaneously with the score data M, and need only be time-divisionally read out and stored in internal RAMs (RAM-P and RAM-S) in the characteristic data extraction block 50, as needed. The extracted characteristic data is temporarily stored in an internal RAM (RAM-C), and can be written in a characteristic data storage area of a common storage unit at a proper time.

The regeneration unit DEC for characteristics of an instrument player will be described below. The characteristic data storage block 50 stores the individuality of the performance of the player i in the external storage unit as the characteristic data (i), as described above. The characteristic data storage block 50 can be divided into those for the characteristic extraction unit ENC and for the characteristic regeneration unit DEC, as indicated by double lines in FIG. 1.

A score data storage block 60 has the same function as that of the above-mentioned score data storage block 30. Therefore, when the characteristic extraction and regeneration units ENC and DEC are constituted by one unit, either of the score data storage blocks 30 and 60 can be omitted. A score N other than the score M is more often read out from the score data storage block 60. Of course, the score M can be read out from the block 60.

A score data compensation block 70 comprises a CPU or a DSP, a ROM, and a RAM, and compensates for score data N read out from the score data storage block 60 with the characteristic data (i) of the player i, thus generating play (performance) data N(i) which is obtained as if the player i were playing the score N. The play data N(i) is constituted by (time information+MIDI code), as described above. The time information has a resolution on the order of milliseconds (ms), as described above.

The score data compensation block 70 executes four stages of processing upon generation of performance data. In the first stage, the block 70 generates tempo sequence data of the entire music piece on the basis of a check result of the tempo marks of the score data N and the tempo marks of the characteristic data (i), and a check result of the general flow of music. In the second stage, the block 70 generates touch sequence data of the entire music piece on the basis of a check result of the dynamic marks of the score data N and the dynamic marks of the characteristic data (i), and a check result of the general flow of music. In the third stage, the block 70 generates note sequence data of the entire music piece on the basis of a check result of note marks or signs attached to notes of the score data N and the notes of the characteristic data (i). In the fourth stage, the block 70 combines the tempo sequence, touch sequence, and note sequence data to generate one play data N(i).

The score data compensation block 70 comprises the CPU as a principal component like in the characteristic data extraction block 40. Therefore, if the characteristic extraction and regeneration units ENC and DEC are constituted by one unit, a single CPU can be shared by the blocks 40 and 70.

A play data storage block 80 stores the performance (play) data N(i) obtained as if the player i were playing the score N. The stored performance data N(i) has the format shown in FIG. 4. Thereafter, the performance data N(i) is sequentially read out in correspondence with the designated tempo, and is transferred to an instrument control block (to be described below) as instrument operation information. These storage and transfer operations are performed under the control of the CPU of the score data compensation block 70. The instrument operation information complies with the MIDI standards.

An instrument control block 90 receives the instrument operation information, and drives an electronic tone generator connected thereto or an acoustic musical instrument such as a piano to produce actual tones. The instrument control block 90 can be a commercially available electronic musical instrument or automatic player piano. Therefore, a description of various functions of the block 90, e.g., "storage/read operations of performance data", "assignment of tone generation channels, "tone generator", "assignment of time measurement counters", and "driving of solenoids corresponding to keys" will be omitted.

FIGS. 6 to 9 show various check items upon extraction of characteristic data, and storage contents of the extracted characteristic data. The characteristic data is roughly classified to four criterions based on score data, and these criterions respectively correspond to FIGS. 6 to 9.

FIG. 6 shows characteristic data extracted and generated by checking performances for note marks or signs attached to notes, and this data includes two groups. The first group includes check items of successive plays of notes (e.g., those of sixteenth to half notes and a triplet), and average data of operation timing data (key depression timings, or times between key depression and key release timings) and operation touch data (initial touch/after touch, and the like) are extracted. The performance data of successive notes expresses the characteristics of the player more clearly than that in units of notes. The second group includes check items of a staccato sign, accent sign, Ped. (pedal) sign, tie sign, and slur sign, and average data of operation timing data and operation touch data are extracted. The Ped. sign is a sign instructing an ON/OFF state of a damper.

FIG. 7 shows characteristic data extracted and generated by checking performances for tempo marks, and this data consists of two groups. The first group includes check items of marks for instantaneously changing a performance tempo (e.g., adagio to presto marks), and average data of operation tempos (times between key depression timings) are extracted. The second group includes check items of marks for gradually changing a performance tempo (ritardando, accelerando, and the like), and variations of operation tempo data are extracted.

FIG. 8 shows characteristic data extracted and generated by checking performances for dynamic marks, and this data consists of two groups. The first group includes check items of marks for instantaneously changing touch strengths (e.g., pianissimo to fortissimo), and average data of operation touch data (initial touch/after touch, and the like) are extracted. The second group includes check items of marks for gradually changing touch strengths (e.g., crescendo and decrescendo), and variations of operation touch data are extracted.

FIG. 9 shows characteristic data extracted and generated by checking performances for the general flow of music. These data are obtained by extracting average data of operation tempo data and operation touch data in correspondence with four portions of music, i.e., a play of the first portion of music, the first play of a repeat portion, the second play of the repeat portion, and a play of the last portion of music. In this extraction operation, shift ratios (%) of tempo and dynamic marks of performance data to those of the corresponding portions of score data, and their shift directions (fast/slow, strong/weak) are extracted as characteristic data.

FIGS. 2A to 2D show a routine for extracting characteristic data executed by the CPU of the characteristic data extraction block 40. In step 100, a RAM-C area of the internal RAM for storing characteristic data is cleared. Thus, all the registers REG+0 to 33 are cleared, and all the characteristic data are reset to a "no-sample" state. When the number of performance data is small, the number of "no-sample" portions is undesirably increased.

In step 101, performance (play) data M(i) is read out from the performance data storage block 20, and is stored in a RAM-P area of the internal RAM. In step 102, score data M is read out from the score data storage block 30, and is stored in a RAM-S area of the internal RAM. The transfer operations to the corresponding RAM areas are performed since the internal RAM allows high-speed accesses. If characteristic extraction need not be performed at high speed, the data may be sequentially read out from the corresponding storage blocks.

In step 103, an address pointer PNT for accessing characteristic data is set at the first characteristic data storage register REG+0. The 34 storage registers have successive addresses.

In step 104, a successive note pattern corresponding to a check item pointed by the pointer PNT is searched from the RAM-S area (score data). If it is determined in step 105 that no corresponding successive note pattern is searched out, the flow jumps to step 108; otherwise, the flow advances to step 106 to detect a corresponding position from the RAM-P area (performance data). In step 107, operation timing data and operation touch data at the detected position are read out, and are stored as characteristic data in a register pointed by the pointer PNT. If the same pattern is present at a plurality of positions, an average of these operation timings is calculated and stored.

In step 108, the content of the pointer PNT is incremented by "1". In step 109, it is checked if the content of the pointer PNT is equal to or larger than REG+9. If NO in step 109, the flow returns to step 104; otherwise, the flow advances to step 110. In this manner, characteristic extraction of the successive note pattern is completed.

In step 110, a sign attached to notes corresponding to a check item pointed by the pointer PNT is searched from the RAM-S area (score data). If it is determined in step 111 that no corresponding sign attached to notes is searched out, the flow jumps to step 114; otherwise, the flow advances to step 112 to detect a corresponding position from the RAM-P area (performance data). In step 113, operation timing data and operation touch data at the detected position are read out, and are stored as characteristic data in a register pointed by the pointer PNT.

In step 114, the content of the pointer PNT is incremented by "1". In step 115, it is checked if the content of the pointer PNT is equal to or larger than REG+14. If NO in step 115, the flow returns to step 110; otherwise, the flow advances to step 116. In this manner, characteristic extraction of signs attached to notes is completed.

In step 116, a tempo mark corresponding to a check item pointed by the pointer PNT is searched from the RAM-S area (score data). The tempo mark means one of adagio, andante, moderato, allegro, and presto. If it is determined in step 117 that no corresponding tempo mark is searched out, the flow jumps to step 120; otherwise, the flow advances to step 118 to detect a corresponding position from the RAM-P area (performance data). In step 119, operation tempo data at the detected position is read out, and is stored as characteristic data in a register (REG+N) pointed by the pointer PNT.

In step 120, the content of the pointer PNT is incremented by "1". In step 121, it is checked if the content of the pointer PNT is equal to or larger than REG+19. If NO in step 121, the flow returns to step 116; otherwise, the flow advances to step 122. In this manner, characteristic extraction of dynamic marks for requesting quick changes is completed.

In step 122, a tempo mark corresponding to a check item pointed by the pointer PNT is searched from the RAM-S area (score data). In this case, the tempo mark means one of rit., accel., and a tempo. If it is determined in step 123 that no corresponding tempo mark is searched out, the flow jumps to step 126; otherwise, the flow advances to step 124 to detect a corresponding position from the RAM-P area (performance data). In step 125, a variation (difference) between the first operation tempo data (e.g., at the beginning of rit.) and the last operation tempo data (e.g., at the end of rit.) at the detected position is calculated, and is stored as characteristic data in a register pointed by the pointer PNT.

In step 126, the content of the pointer PNT is incremented by "1". It is checked in step 127 if the content of the pointer PNT is equal to or larger than REG+22. If NO in step 127, the flow returns to step 122; otherwise, the flow advances to step 128. In this manner, characteristic extraction of tempo marks requesting smooth changes is completed.

In step 128, a dynamic mark corresponding to a check item pointed by the pointer PNT is searched from the RAM-S area (score data). In this case, the dynamic mark means one of pp, p, mp, mf, f, and ff. If it is determined in step 129 that no corresponding dynamic mark is detected, the flow jumps to step 132; otherwise, the flow advances to step 130 to detect a corresponding position from the RAM-P area (performance data). In step 131, operation touch data at the detected position is read out, and is stored as characteristic data in a register pointed by the pointer PNT.

In step 132, the content of the pointer PNT is incremented by "1". In step 133, it is checked if the content of the pointer PNT is equal to or larger than REG+28. If NO in step 133, the flow returns to step 128; otherwise, the flow advances to step 134. In this manner, characteristic extraction of dynamic marks requesting quick changes is completed.

In step 134, a dynamic mark corresponding to a check item pointed by the pointer PNT is searched from the RAM-S area (score data). In this case, the dynamic mark means one of crescendo and decrescendo. If it is determined in step 135 that no corresponding dynamic mark is searched out, the flow jumps to step 138; otherwise, the flow advances to step 136 to detect a corresponding position from the RAM-P area (performance data). In step 137, a variation of touch data is calculated based on the first operation touch data (e.g., at the beginning of crescendo) and the last operation touch data (e.g., at the end of crescendo) at the detected position, and is stored as characteristic data in a register pointed by the pointer PNT.

In step 138, the content of the pointer PNT is incremented by "1". In step 139, it is checked if the content of the pointer PNT is equal to or larger than REG+30. If NO in step 139, the flow returns to step 134; otherwise, the flow advances to step 140. In this manner, characteristic extraction of dynamic marks requesting smooth changes is completed.

In step 140, performance data corresponding to the first four bars of music data in the RAM-S area (score data) is read out from the RAM-P area (performance data). In step 141, operation touch data of the corresponding portion is read out, and at the same time, operation tempo data is calculated. These data are stored as characteristic data in a register pointed by the pointer PNT. In step 142, the content of the pointer PNT is incremented by "1". As for the operation touch data, an average strength of a plurality of key depression operations is calculated, and the operation tempo data is calculated back from a time required for playing the four bars.

In step 143, performance data corresponding to the first four bars of the first play of a repeat portion of data in the RAM-S area (score data) is read out from the RAM-P area (performance data). In step 144, operation touch data and operation tempo data of the readout portion are calculated, and are stored as characteristic data in a register pointed by the pointer PNT. In step 145, the content of the pointer PNT is incremented by "1".

In step 146, performance data corresponding to the first four bars of the second play of a repeat portion of data in the RAM-S area (score data) is read out from the RAM-P area (performance data). In step 147, operation touch data and operation tempo data of the readout portion are calculated, and are stored as characteristic data in a register pointed by the pointer PNT. In step 148, the content of the pointer PNT is incremented by "1".

In step 149, performance data corresponding to the last four bars of the music data in the RAM-S area (score data) is read out from the RAM-P area (performance data). In step 150, operation touch data and operation tempo data of the readout portion are calculated, and are stored as characteristic data in a register pointed by the pointer PNT. In steps 140 to 150 described above, characteristic extraction of the general flow of music is completed.

In step 151, the content of the RAM-C area (REG+0 to 33) which stores the extracted characteristic data is transferred to and stored in the characteristic data storage block 50.

Figure 3:
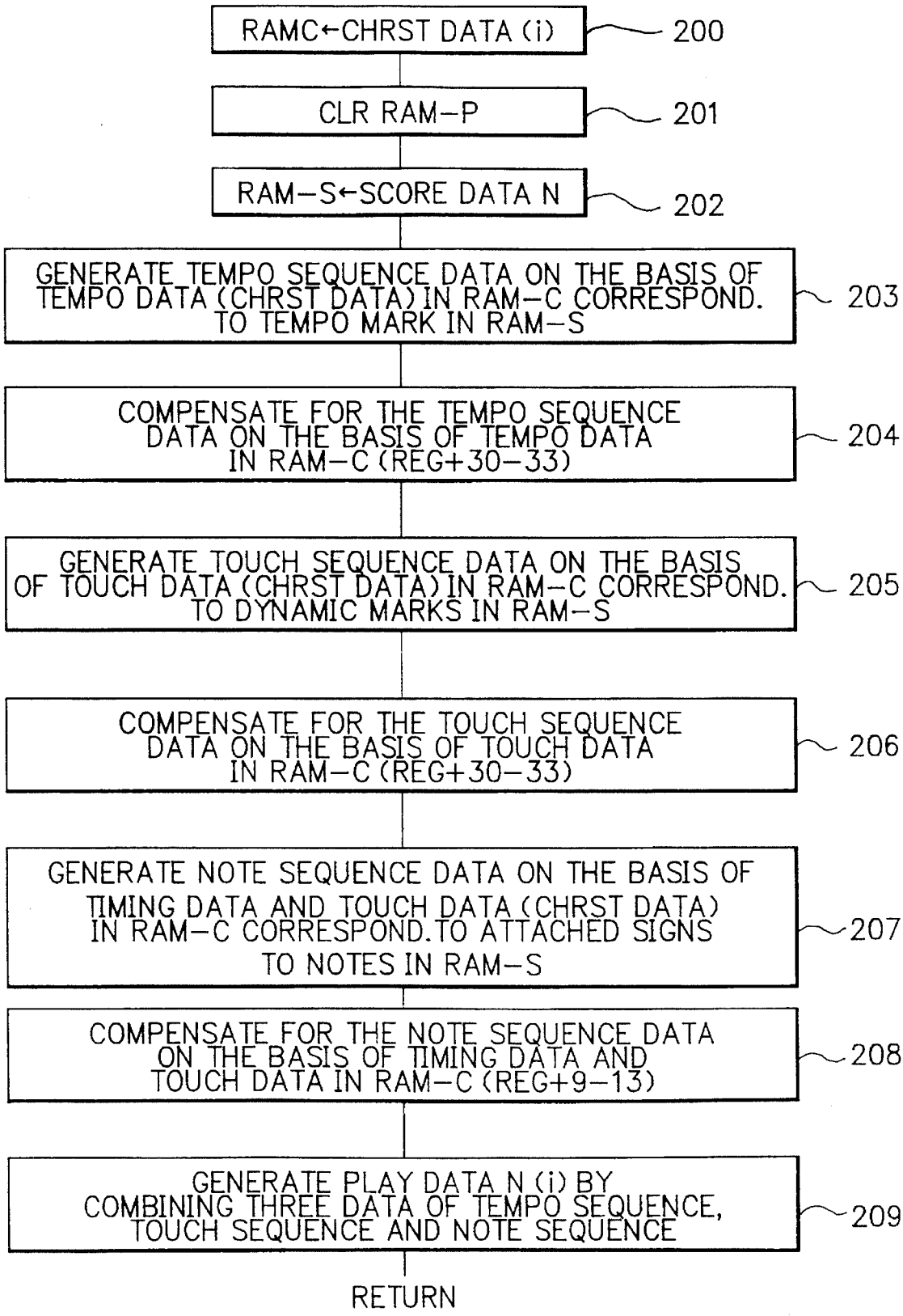
FIG. 3 is a flow chart of a score data compensation unit.

FIG. 3 shows a routine for generating performance data executed by the CPU of the score data compensation block 70. In step 200, characteristic data read out from the characteristic data storage block 50 is stored in a RAM-C area of the internal RAM. In step 201, a RAM-P area of the internal RAM for storing performance data is cleared. In step 202, score data N read out from the score data storage block 60 is stored in a RAM-S area of the internal RAM.

In step 203, tempo sequence data of the entire music is generated on the basis of check results (REG+14 to 21) of the tempo marks in the RAM-S area (score data N) and the tempo marks in the RAM-C area (characteristic data (i)).

For example, if an "andante" mark is stored in the RAM-S area (score data N), a tempo numerical value which may be used by the player i at that time is read out with reference to the content of the register REG+15 in the RAM-C area (characteristic data (i)). If a "rit." mark is stored in the RAM-S area (score data N), the termination time until a tempo is stabilized at a constant slow tempo and the variation of tempo are read out with reference to the content of the register REG+19 in the RAM-C area (characteristic data (i)).

The tempo sequence data is stored, as shown in FIG. 10. That is, tempo sequence data consists of step time data from the beginning of a bar at a resolution of 1/96 a quarternote for specifying a tempo change time, and changed tempo data. The resolution of 1/96 a quarternote has a precision four times the resolution of score data in FIG. 5. This is to store as characteristic data a performance technique which is too delicate to express as a note. For this reason, the duration time of a whole note cannot be expressed by 1 byte, and the actual beginning of a bar (bar duration information=00h) and a time advanced from the beginning of the bar by a half note (bar duration information 01h) can be separately expressed in bar information. Since this storage method detects and stores a change in operation, a large number of tempo data are successively stored for "rit." and "accel." marks which require smooth changes.

In step 204, the generated tempo sequence data is compensated for on the basis of the check results (REG+30 to 33) for the general flow of music in the RAM-C area (characteristic data (i)). This compensation operation is to increase/decrease tempo data of the respective portions (the first portion of music, the first play of the repeat portion, the second play of the repeat portion, and the last portion of music) by several percents on the basis of the stored contents of characteristic data.

In step 205, touch sequence data of the entire music is generated on the basis of the check results (REG+22 to 29) for the dynamic marks in the RAM-S area (score data N) and the dynamic marks in the RAM-C area (characteristic data (i)).

For example, if an "mp" mark is stored in the RAM-S area (score data N), a touch numerical value which may be used by the player i at that time is read out with reference to the content of the register REG+24 in the RAM-C area (characteristic data (i)). If a "crescendo" mark is stored in the RAM-S area (score data N), the termination time until touch data is stabilized at a constant strong touch and the variation of touch are read out with reference to the content of the register REG+13 in the RAM-C area (characteristic data (i)).

The touch sequence data is stored as shown in FIG. 10 as in the tempo sequence data. That is, the touch sequence data is defined by step time data from the beginning of a bar at a resolution of 1/96 a quarternote for specifying a touch change time, and a changed touch numerical value. Therefore, a large number of touch data are successively stored for "crescendo" and "decrescendo" marks which require smooth changes.

In step 206, the generated touch sequence data is compensated for on the basis of the check results (REG+30 to 33) for the general flow of music in the RAM-C area (characteristic data (i)). This compensation operation is to increase/decrease touch data of the respective portions (the first portion of music, the first play of the repeat portion, the second play of the repeat portion, and the last portion of music) by several percents on the basis of the stored contents of characteristic data.

In step 207, note sequence data of the entire music is generated on the basis of the check results (REG+0 to 8) for notes or signs attached to notes in the RAM-S area (score data N) and note marks in the RAM-C area (characteristic data (i)).

The note sequence data is generated as follows. For example, if "eighth note+sixteenth note" marks are stored in the RAM-S area (score data N), timing data (key depression/key release time) and touch data which may be used by the player i at that time are read out with reference to the content of the register REG+2 in the RAM-C area (characteristic data (i)), and are stored on the sequence.

In step 208, the note sequence data is compensated for on the basis of signs attached to notes. For example, if a "slur" sign is stored in the RAM-S area (score data N), timing and touch data of the corresponding portion of the note sequence data are compensated for with reference to the content of the register REG+13 in the RAM-C area (characteristic data (i)).

FIG. 11 shows the storage format of the note sequence data. The note sequence data is defined by step time data from the beginning of a bar at a resolution of 1/96 a quarternote for specifying a note change time, and changed note data. In a performance using an automatic performance piano, the note sequence data need only include note information (gate time), foot SW information, bar information, and end information. In a performance using an electronic musical instrument, the note sequence data also requires after touch information, tone color information, tone volume information, effect information, and sound effect information, and the like in addition to the above-mentioned four pieces of information, and sequence data associated with these information are also generated at that time.

In step 209, performance data N(i) is generated on the basis of three sequence data, i.e., tempo sequence data, touch sequence data, and note sequence data. Step 209 is processing for converting the new performance data N(i) to the same format as that of the performance data M(i) stored first, as shown in FIG. 4.

A major difference between the storage format of the performance data M(i) shown in FIG. 4 and the storage formats of FIGS. 10 (tempo/touch sequence data) and 11 (note sequence data) is the management method of time information. In FIG. 4, a time from a previous change is measured in units of ms (milliseconds) independently of the performance tempo, while in FIGS. 10 and 11, a time from the beginning of a bar is measured at a resolution of 1/96 a quarternote on the basis of the performance tempo. Therefore, the processing in step 209 is mainly conversion of the time information.

In consideration of only regeneration, the tempo, touch, and note sequence data may be independently used as performance data N(i). This is because, in an existing sequencer for an electronic musical instrument, a tempo sequence and a note sequence are independent of each other, as is known to those who are skilled in the art, and a change in touch amount output from a touch sequence need only be output as touch sense data.

A difference between score data and performance data in association with a triplet will be described below for the purpose of giving a more detailed explanation of the present invention.

FIG. 12 shows data obtained by directly converting a triplet of quarternotes stored on a score into performance data, and performance data of Examples 1 and 2 obtained by playing the triplet by two players. Since the resolution of the step time is 1/96 a quarternote, a time used by each note is ideally 96 clocks/3=32 clocks. When the 32 clocks are divided at a ratio of 3 : 1 of a key operation time (ON time) to a release time (OFF time), a delta (D) time sequence (24, 8, 24, 8, 24, 8) shown in the left-hand column in FIG. 12 is obtained.

However, in an actual performance, these timings are shifted. For example, in Example 1 of performance data, the second note of the triplet is played to have a relatively longer duration. At this time, the timing of the third note of the triplet is delayed from the theoretical key depression timing.

In Example 2 of performance data, the first note of the triplet is played to have a relatively longer duration. At this time, the second and third notes of the triplet are delayed from their theoretical key depression timings.

In an actual performance, a total of performance (key depression) times of notes of a triplet is shifted from the theoretical time, and the total time of the triplet is normally longer than the theoretical time. This shift amount differs depending on players, and is one of characteristics of a performance.

Furthermore, a player may play notes of a triplet to be stronger those before and after the triplet, and another player may intentionally play a specific note in a triplet to be stronger than other notes. Therefore, in addition to the key depression time described above, an operation touch (initial touch and after touch) for the played note also becomes one of characteristics.

Moreover, as for the triplet, a performance effect varies depending on a difference in key depression time between key depression and release timings even at the same key depression timing. The time between key depression and release timings becomes relatively short when notes are played in a staccato manner, and the time becomes relatively long when notes are played in a tenuto manner.

The present invention is not limited to the above embodiment, and various changes and modifications may be made without departing from the scope of the invention. For example, in the storage format, characteristic data need not be extracted by mainly checking successive notes on a score. Alternatively, characteristics of a player for single notes may be extracted. In the above embodiment, characteristic data is generated by extracting characteristics of only one score data M. However, when a plurality of score data are used, characteristic extraction can be performed with higher precision in units of genres.

As described above, an extraction apparatus for characteristics of an instrument player according to the present invention compensates for score data of a music piece, which has never been played by a player, with stored characteristic data extracted from performance data of a music piece, which was played by the player so as to imitate the individuality of a performance of the player, and a natural and delicate music can be provided to an audience.

What is claimed is:

1. An apparatus for extracting characteristics of an instrument player, comprising:

performance data storage means for storing performance data obtained upon performance of an instrument by the player;

score data storage means for storing score data of the performance;

characteristic data extraction means for extracting characteristic data on the basis of the performance data and the score data including checking the correlation between the performance and score data; and characteristic data storage means for storing the characteristic data, wherein a style of the characteristics of performance of the player is extracted and stored.

2. An apparatus according to claim 1, wherein the characteristic data includes at least one of an operation timing, an operation tempo, and an operation touch of the player for different signs attached to notes on a score.

3. An apparatus according to claim 1, wherein the characteristic data includes at least one of an operation tempo and an operation touch of the player associated with music.

4. An apparatus according to claim 1, wherein said characteristic data extraction means comprises means for extracting the characteristic data from said performance data with regard to styles of performance in association with at least one of notes pattern, signs attached to the notes, dynamic marks, and tempo marks, with reference to the score data.

5. An apparatus for extracting characteristics of an instrument player, comprising:

performance data storage means for storing performance data obtained upon performance of an instrument by the player;

score data storage means for storing score data of the performance;

characteristic data extraction means for extracting characteristic data on the basis of the performance data and the score data;

the characteristic data extraction means including:

searching means for searching for at least one of specific notes pattern, signs attached to the notes, dynamic marks, tempo marks and repeat marks in the score data, detecting means which receives positional data of searched out notes patterns, signs, marks in the score data from said searching means, and detects data of operation timing, operation tempo, operation touch at corresponding positions in the performance data, and data processing means which receives said data of operation timing, operation tempo, operation touch from said detecting means to process the data for generating the characteristic data.

6. An apparatus for regenerating characteristics of an instrument player, comprising:

score data storage means for storing score data;

characteristic data storage means for storing an individuality of a performance of the player as characteristic data; and score data compensation means for compensating for the score data on the basis of the characteristic data, wherein an instrument performance imitating the individuality of the performance of the player can be regenerated.

7. An apparatus according to claim 6, wherein the characteristic data includes at least one of an operation timing, an operation tempo, and an operation touch of the player for different signs attached to notes on a score.

8. An apparatus according to claim 6, wherein the characteristic data includes at least one of an operation tempo and an operation touch of the player associated with music.

9. An apparatus according to claim 6, wherein said characteristic data in said characteristic data storage means is extracted with regard to styles of performance in association with at least one of notes patterns, signs attached to the notes, dynamic marks and tempo marks, on the basis of performance data containing individuality of a player with regard to one of operation timing, operation tempo and operation touch, with reference to score data corresponding to the performance and containing no individuality.

10. An apparatus for regenerating characteristics of an instrument player, comprising:

score data storage means for storing score data;

characteristic data storage means for storing an individuality of a performance of the player as characteristic data;

score data compensation means for compensating for the score data on the basis of the characteristic data;

in association with at least one of notes pattern, signs attached to the notes, dynamic marks, tempo marks, and the general flow of music, with reference to the score data;

said characteristic data in said characteristic data storage means is extracted with regard to styles of performance in association with at least one of notes patterns, signs attached to the notes, dynamic marks, tempo marks, and the general flow of music, on the basis of performance data containing individuality of a player with regard to one of operation timing, operation tempo and operation touch, with reference to score data corresponding to the performance and containing no individuality; and said score data compensation means comprises:

searching means for searching for at least one of specific notes patterns, signs attached to the notes, dynamic marks, tempo marks and repeat marks in the score data in said score data storage means, data read-out means which reads out from the characteristic data storage means for characteristic data corresponding to said searched out notes patterns, signs, marks in the score data by said searching means, data processing means which receives said characteristic data from said read-out means and compensates for the score data to generate note sequence data, tempo sequence data and touch sequence data which are corrected by said characteristic data, and generation means for generating play data imitating the individuality of the performance of the player on the basis of said note sequence data, tempo sequence data and touch sequence data.

11. Apparatus according to claim 10, wherein said data processing means further comprises correction means for correcting the note sequence data, tempo sequence data and touch sequence data by said characteristic data regarding general flow of music.

* * * * *